US007239323B2

(12) United States Patent
Park

(10) Patent No.: US 7,239,323 B2
(45) Date of Patent: Jul. 3, 2007

(54) COLOR DISPLAY DRIVING APPARATUS IN A PORTABLE MOBILE TELEPHONE WITH COLOR DISPLAY UNIT

(75) Inventor: Sang-Ryul Park, Kumi (KR)

(73) Assignee: Samsung Electronics Co., Ltd. (KR)

( * ) Notice: Subject to any disclaimer, the term of this patent is extended or adjusted under 35 U.S.C. 154(b) by 160 days.

(21) Appl. No.: 09/865,200

(22) Filed: May 24, 2001

(65) Prior Publication Data

US 2002/0039105 A1 Apr. 4, 2002

(30) Foreign Application Priority Data

Sep. 29, 2000 (KR) ..... 2000-57324

(51) Int. Cl.
*G09G 5/39* (2006.01)

(52) U.S. Cl. ..... 345/531; 345/535; 345/549; 345/603; 345/604; 379/29.1; 379/88.11; 379/93.23; 379/142.17; 379/433.04; 455/566; 715/864

(58) Field of Classification Search ..... 345/603–605, 345/756, 864, 535, 549; 379/433.04, 93.23, 379/142.17, 29.1; 455/566; 715/756, 864
See application file for complete search history.

(56) References Cited

U.S. PATENT DOCUMENTS

| | | | | |
|---|---|---|---|---|
| 4,599,611 | A | 7/1986 | Bowker et al. | |
| 4,908,614 | A * | 3/1990 | Yamagishi | 345/534 |
| 5,220,312 | A * | 6/1993 | Lumelsky et al. | 345/563 |
| 5,243,447 | A * | 9/1993 | Bodenkamp et al. | 345/629 |
| 5,406,306 | A | 4/1995 | Siann et al. | |
| 5,517,612 | A * | 5/1996 | Dwin et al. | 345/502 |
| 5,808,630 | A | 9/1998 | Pannell | |
| 5,821,918 | A | 10/1998 | Reinert et al. | |
| 5,844,541 | A * | 12/1998 | Cahill, III | 345/667 |
| 5,844,623 | A * | 12/1998 | Iwamura | 725/70 |
| 5,852,444 | A | 12/1998 | Lippincott | |
| 6,034,667 | A * | 3/2000 | Barrett | 345/603 |
| 6,166,720 | A * | 12/2000 | Sim | 345/604 |
| 6,268,847 | B1 * | 7/2001 | Glen | 345/604 |
| 6,297,832 | B1 * | 10/2001 | Mizuyabu et al. | 345/540 |
| 6,339,422 | B1 * | 1/2002 | Kuwajima et al. | 345/204 |
| 6,353,440 | B1 * | 3/2002 | Keene | 345/603 |
| 6,459,906 | B1 * | 10/2002 | Yang | 455/556.1 |

(Continued)

FOREIGN PATENT DOCUMENTS

DE 199 62 922 A1 12/1999

(Continued)

*Primary Examiner*—Kee M. Tung
*Assistant Examiner*—Antonio Caschera
(74) *Attorney, Agent, or Firm*—The Farrell Law Firm

(57) ABSTRACT

A color display driving apparatus that simultaneously on-screen displays an RGB format color image and a YUV format color image on the same color display unit. A first memory stores YUV data, and a YUV-RGB converter converts YUV data read from the first memory to RGB data. A second memory stores RGB data. An on-screen-display (OSD) controller writes the YUV data and the RGB data in the first and second memories, respectively, mixes the RGB data converted from the YUV data stored in the first memory by the YUV-RGB converter with the RGB data read from in the second memory, and on-screen displays the mixed data.

5 Claims, 2 Drawing Sheets

U.S. PATENT DOCUMENTS

| | | | | |
|---|---|---|---|---|
| 6,466,204 | B1 * | 10/2002 | Oh | 345/213 |
| 7,057,621 | B2 * | 6/2006 | Kwon et al. | 345/531 |

FOREIGN PATENT DOCUMENTS

| | | | |
|---|---|---|---|
| DE | 101 47 317 | A1 | 9/2001 |
| GB | 2334642 | A | 8/1999 |
| JP | 7-104723 | | 4/1995 |
| JP | 08-289312 | | 1/1996 |
| JP | 08-289313 | | 1/1996 |
| JP | 08307893 | A | 11/1996 |
| JP | 10-040366 | | 2/1998 |
| JP | 10-210499 | | 7/1998 |
| JP | 2000-078609 | | 3/2000 |

* cited by examiner

COLOR DISPLAY DRIVING APPARATUS IN A PORTABLE MOBILE TELEPHONE WITH COLOR DISPLAY UNIT

PRIORITY

This application claims priority to an application entitled "Color Display Diving Apparatus in a Portable Mobile Telephone with Color Display Unit" filed in the Korean Industrial Property Office on Sep. 29, 2000 and assigned Serial No. 2000-57324, the contents of which are hereby incorporated by reference.

BACKGROUND OF THE INVENTION

1. Field of the Invention

The present invention relates generally to a portable mobile telephone, and in particular, to a portable mobile telephone with a color display unit.

2. Description of the Related Art

Recently, a portable mobile telephone has been designed to support a VOD (Video On Demand) function, a television broadcasting reception function and a videophone function as well as the traditional voice call function. Such a portable mobile telephone includes a color display unit such as a color LCD (Liquid Crystal Display) to display color images.

An image format for expressing a digital color image includes 'YUV' format and 'YIQ' format in addition to the traditional 'RGB' format used for a color computer graphic and a color television. The 'RGB' format expresses a color image with Red (R), Green (G) and Blue (B) components, while the YUV format expresses a color image with one luminance component Y and two color components U and V. The YIQ format is similar to the YUV format.

As stated above, there are several color image formats compatible with one another. Unfortunately, a portable mobile telephone employing an RGB color display unit for displaying an RGB color image cannot display a YUV color image. For example, when it is necessary to on-screen display a 256-color RGB image received from the outside and an internally generated true-color YUV background image on the color display unit, the portable mobile telephone with the RGB color display unit cannot do so.

SUMMARY OF THE INVENTION

It is, therefore, an object of the present invention to provide a color display driving apparatus capable of simultaneously on-screen displaying an RGB format color image and a YUV format color image on a color display unit.

To achieve the above and other objects, there is provided a color display driving apparatus in a portable mobile telephone with a color display unit. A first memory stores YUV data, and a YUV-RGB converter converts YUV data read from the first memory to RGB data. A second memory stores RGB data. An on-screen-display (OSD) controller writes the YUV data and the RGB data in the first and second memories, respectively, mixes the RGB data converted from the YUV data stored in the first memory by the YUV-RGB converter with the RGB data read from in the second memory, and on-screen displays the mixed data on the color display unit.

Further, the color display apparatus includes a display format converter for converting the YUV data read from the first memory to a format compatible with the color display unit, and providing the converted data to the YUV-RGB converter.

The OSD controller comprises: a timing signal generator for generating a timing signal for alternately enabling the first and second memories for a write operation and a read operation, and providing the generated timing signal to the first and second memories; and an OSD mixer for mixing the RGB data output from the YUV-RGB converter with the RGB data output from the second memory.

BRIEF DESCRIPTION OF THE DRAWINGS

The above and other objects, features and advantages of the present invention will become more apparent from the following detailed description when taken in conjunction with the accompanying drawings in which.

DETAILED DESCRIPTION OF THE PREFERRED EMBODIMENT

A preferred embodiment of the present invention will be described herein below with reference to the accompanying drawings. In the following description, well-known functions or constructions are not described in detail since they would obscure the invention in unnecessary detail. While the present invention is described herein below using the YUV format, the present invention is also applicable to the YIQ format.

Figure 1:
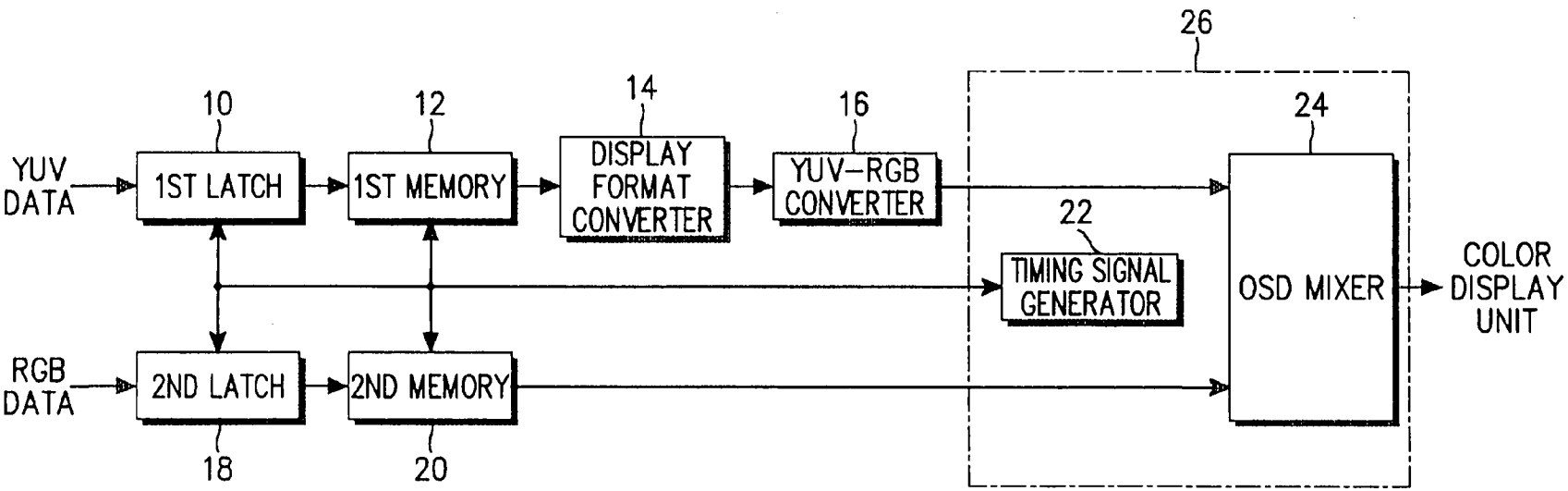
FIG. 1 is a block diagram illustrating a color display driving apparatus according to an embodiment of the present invention.

FIG. 1 illustrates a color display driving apparatus according to an embodiment of the present invention. Referring to FIG. 1, the color display driving apparatus includes first and second latches 10 and 18, first and second memories 12 and 20, a display format converter 14, a YUV-RGB converter 16, and an OSD controller 26. The OSD controller 26 includes a timing signal generator 22 and an OSD mixer 24. In the following description, it will be assumed that the first latch 10 receives 16-bit YUV data, the second latch 18 receives 8-bit or 16-bit RGB data, and a color display unit (not shown) displays an RGB format color image having a size of 176 (horizontal pixels)×218 (vertical pixels). Connected to an output end of the OSD mixer 24 is an LCD driver IC (Integrated Circuit, not shown) of the color display unit. The LCD driver IC converts the RGB format color image data output from the OSD mixer 24 to an analog RGB image signal using a D/A (Digital-to-Analog) converter (not shown) and displays the converted analog RGB image signal on the color display unit. In general, two YUV pixels are expressed with Y:U=8 bits and Y:V=8 bits, and one YUV pixel is expressed with (Y:U:V=8:4:4)=16 bits. Further, since R:G:B=3:3:2, one RGB pixel is expressed with 8 bits and two RGB pixels are expressed with 16 bits.

The first latch 10 latches 16-bit YUV input data according to a timing signal provided from the timing signal generator 22, and writes the input data in the first memory 12. The first memory 12 stores 1-frame YUV data. For example, the first memory 12 stores 1-frame YUV data having the size of 176 (horizontal pixels)×144 (vertical pixels) specified in MPEG4 (Moving Picture Expert Group 4). The first memory 12 stores the YUV data output from the first latch 10 pixel by pixel when the timing signal generated from the timing signal generator 22 is enabled for a write operation. Further, when the timing signal is enabled for a read operation, the first memory 12 reads the stored YUV data pixel by pixel and provides the read data to the display format converter 14. The display format converter 14 converts the YUV format data read from the first memory 12 to a data format compatible with the color display unit. In the embodiment of the present invention, the display format converter 14 converts the image data by expanding the number of vertical pixels of the YUV data 1.5 times from 144 to 218. When the converted YUV format data is represented by YUV_Y, YUV_U and YUV_V, the YUV-RGB converter 16 converts the 16-bit YUV format data YUV_Y, YUV_U and YUV_V to 24-bit RGB format data (i.e., the color components R, G and B each including 8 bits), and provides the converted RGB format data to the OSD mixer 24. In the following description, the 8-bit R, G and B components of the RGB format data output from the YUV-RGB converter 16 are represented by YUV_R, YUV_G and YUV_B, respectively. The YUV-RGB converter 16 converts the image format in accordance with Equation (1) below.

$$R=Y+11/8\times(V-128)$$

$$G=Y-45/64\times(V-128)-43/128\times(U-128)$$

$$B=Y+111/6\times(U-128)$$

The second latch 18 latches the 8-bit or 16-bit RGB input data according to the timing signal provided from the timing signal generator 22, and writes the input data in the second memory 20. The second memory 20 stores 1-frame RGB data having the size of 176 (horizontal pixels)×218 (vertical pixels). The second memory 20 stores the RGB data output from the second latch 18 pixel by pixel when the timing signal generated from the timing signal generator 22 is enabled for a write operation. Further, when the timing signal is enabled for a read operation, the second memory 20 reads the stored RGB data pixel by pixel and provides the read data to the OSD mixer 24. In the following description, the 8-bit RGB data (i.e., the color components R and G each including 3 bits and the color component B including 2 bits) output from the second memory 20 are represented by RGB_R, RGB_G and RGB_B, respectively.

Figure 2:
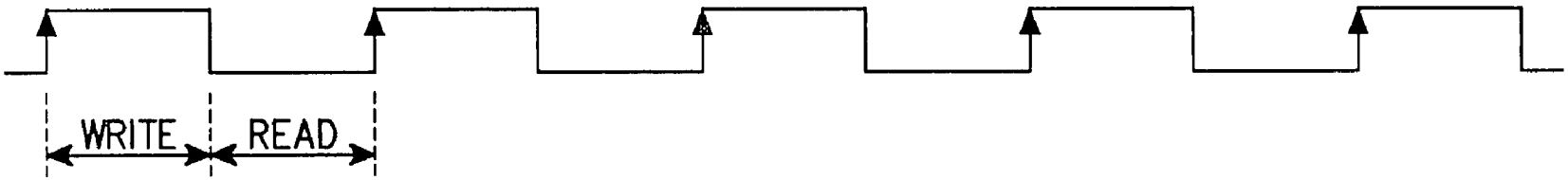
FIG. 2 is a timing diagram illustrating a timing signal used in the color display driving apparatus of FIG. 1.

In the OSD controller 26, the timing signal generator 22 generates the timing signal shown in FIG. 2, and provides the generated timing signal to the first and second latches 10 and 18 and the first and second memories 12 and 20, to thereby write the YUV and RGB data in the first and second memories 12 and 20, respectively. The YUV data stored in the first memory 12 is converted to the RGB data through the display format converter 14 and the YUV-RGB converter 16. The RGB data output from the YUV-RGB converter 16 is mixed for on-screen display by the OSD mixer 24 with the RGB data read from the second memory 20 and then, provided to the color display unit. At this point, the OSD controller 26 alternately writes and reads the YUV and RGB data into/from the first and second memories 12 and 20 through the first and second latches 10 and 18 on a pixel unit basis, respectively, and simultaneously provides the YUV_R, YUV_G and YUV_B output from the YUV-RGB converter 16 and the RGB_R, RGB_G RGB_B read from the second memory 20 to the OSD mixer 24.

The timing signal generator 22 generates the timing signal of FIG. 2, so that the first and second memories 12 and 20 should be alternately enabled for the read operation and the write operation. The timing signal generator 22 provides the generated timing signal to the first and second memories 12 and 20. FIG. 2 shows an example of the timing signal, which is 'HIGH' in a write interval and 'LOW' in a read interval. A period of the timing signal depends on the vertical scanning frequency. The first and second latches 10 and 18 latch the YUV data and the RGB data at the rising edge of the timing signal in the write interval, respectively. The first and second memories 12 and 20 are enabled for a write operation in the write interval of 'HIGH', and enabled for a read operation in the read interval of 'LOW'.

Therefore, in the write interval of the timing signal, the first memory 12 is enabled for a write operation and then the YUV data latched by the first latch 10 is written in the first memory 12. Subsequently, in the read interval of the timing signal, the first memory 12, enabled for a read operation, reads the YUV data written therein and provides the read data to the display format converter 14. In the same manner, in the write interval of the timing signal, the second memory 20 is enabled for a write operation and then the RGB data latched by the second latch 18 is written in the second memory 20. Subsequently, in the read interval of the timing signal, the second memory 20, enabled for a read operation, reads the RGB data RGB_R, RGB_G, RGB_B written therein and provides the read data to the OSD mixer 24.

After reading the YUV data YUV_R, YUV_G, YUV_B and the RGB data RGB_R, RGB_G, RGB_B, the OSD controller 26 switches the timing signal to 'HIGH' to enable the first and second memories 12 and 20 for the write operation. Then, the first and second memories 12 and 20 write 1-pixel YUV data and 1-pixel RGB data, respectively, mix the read 1-pixel YUV data YUV_R, YUV_G, YUV_B and the read 1-pixel RGB data RGB_R, RGB_G, RGB_B for on-screen display (OSD). Thereafter, the OSD controller 26 switches the timing signal to 'LOW' to enable the first and second memories 12 and 20 for the read operation. Then, the first and second memories 12 and 20 read the YUV data and the RGB data, respectively. The foregoing operations are then routinely repeated.

In the following description, the YUV data YUV_R, YUV_G and YUV_B provided to the OSD mixer 24 are represented by PICT_R, PICT_G and PICT_B. Each piece of data is comprised of 8 bits, respectively. The RGB data RGB_R, RGB_G and RGB_B provided to the OSD mixer 24 are represented by RGB_DATA comprised of 8 bits. The OSD mixer 24 mixes the 1-pixel RGB_DATA received from the second memory 20 with the 1-pixel YUV data PICT_R, PICT_G, PICT_B received from the YUV-RGB converter 16, and provides the mixed data to the color display unit. At this moment, the OSD mixer 24 expands the 8-bit RGB_DATA to 24-bit RGB_DATA. As stated above, the RGB_DATA is comprised of the 3-bit R component, the 3-bit G component and the 2-bit B component. Therefore, to expand each of the R, G and B components to 8 bits, the OSD mixer 24 converts '110', for example, of the 3-bit R or G component to '11111100' and converts '10', for example, of the 2-bit B component to '11110000'. Here, converting '110' to '11111100' is equivalent to converting '1' to '11' and '0' to '00', respectively. Further, converting '10' to '11110000' is equivalent to converting '1' to '1111' and '0' to '0000', respectively.

In the following description, the data expanded from the RGB_DATA will be represented by INT_R, INT_G and INT_B each comprised of 8 bits. Then, PICT_R, PICT_G, PICT_B and INT_R, INT_G, INT_B each are comprised of 8 bits in the OSD mixer 24. In addition, the OSD mixer 24 first outputs INT_R, INT_G and INT_B and when a predetermined color is obtained from INT_R, INT_G and INT_B, the OSD mixer 24 outputs PICT_R, PICT_G and PICT_B, without outputting INT_R INT_G and INT_B. For example, the white color is obtained when INT_R, INT_G and INT_B are all set to '1'. In this case, the OSD mixer 24 outputs PICT_R, PICT_G and PICT_B, ignoring INT_R, INT_G and INT_B. Therefore, it is possible to simultaneously display an RGB format color image and a YUV format color image on a single color display unit by storing 1-frame YUV data and 1-frame RGB data in the first and second memories 12 and 20 pixel by pixel, respectively, reading the data from the first and second memories 12 and 20 pixel by pixel, converting the read YUV data to RGB data and then mixing the converted RGB data with the RGB data read from the second memory 20.

While the invention has been shown and described with reference to a certain preferred embodiment thereof, it will be understood by those skilled in the art that various changes in form and details may be made therein without departing from the spirit and scope of the invention as defined by the appended claims. In particular, since the first and second latches 10 and 18 are used to match the timing when the YUV data is written in the first memory 12 with the timing when the RGB data is written in the second memory 20, they can be removed if the YUV data is well matched to the RGB data. In addition, the display format converter 14 can be removed if the format of the input image data stored in the first memory 12 is compatible with the color display unit.

What is claimed is:

1. A color display driving apparatus in a portable mobile telephone with a color display unit, comprising:

means for independently receiving by the portable mobile telephone YUV and RGB data in digital format;

a first memory located within the portable mobile telephone for storing YUV data;

a second memory located within the portable mobile telephone for storing RGB data;

a timing signal generator located within the portable mobile telephone for generating a timing signal for alternatively obtaining access to the first and second memories, and for providing the generated timing signal to the first and second memories;

a YUV-RGB converter located within the portable mobile telephone for converting YUV data read from the first memory to RGB data;

an on-screen-display (OSD) controller located within the portable mobile telephone for writing the YUV data and the RGB data in the first and second memories, respectively, mixing the RGB data converted from the YUV data stored in the first memory by the YUV-RGB converter with the RGB data read from the second memory, and on-screen displaying the mixed data on the color display unit of the portable mobile telephone.

2. The color display driving apparatus as claimed in claim 1, further comprising a display format converter for converting the YUV data read from the first memory to a format compatible with the color display unit, and providing the converted data to the YUV-RGB converter.

3. The color display driving apparatus as claimed in claim 1, wherein the OSD controller further comprises:

an OSD mixer for mixing the RGB data output from the YUV-RGB converter with the RGB data output from the second memory.

4. A method of simultaneously displaying on an on-screen-display (OSD) of an RGB format color image and a YUV format color image, said OSD being a color display unit in a portable mobile telephone, the method comprising the steps of:

storing YUV data in a first memory located within the portable mobile telephone;

storing RGB data in a second memory located within the portable mobile telephone;

generating in the portable mobile telephone a timing signal for alternatively obtaining access to the first and second memories and providing the generated timing signal to the first and second memories;

converting in the portable mobile telephone said YUV data stored in the first memory to digital RGB data;

mixing in the portable mobile telephone the converted RGB data and the RGB data from the second memory in an OSD mixer of an OSD controller; and displaying said mixed data on the color display unit located within the portable mobile telephone.

5. The method of claim 4, further comprising steps of:

receiving YUV data in a first latch;

receiving digital RGB data in a second latch;

converting the YUV data from the first memory to a format compatible with the color display unit.

* * * * *